US006105884A

United States Patent [19]

Molnar et al.

[11] Patent Number: 6,105,884

[45] Date of Patent: Aug. 22, 2000

[54] FUEL INJECTOR WITH MOLDED PLASTIC VALVE GUIDES

[75] Inventors: James Robert Molnar, Penfield; Paul S. Von Bacho, III; Otto Muller-Girard, Jr., both of Rochester, all of N.Y.

[73] Assignee: Delphi Technologies, Inc., Troy, Mich.

[21] Appl. No.: 09/396,968

[22] Filed: Sep. 15, 1999

[51] Int. Cl.[7] ..... F02M 51/00

[52] U.S. Cl. ..... 239/585.1; 251/129.21; 137/625.33

[58] Field of Search ..... 239/533.2, 533.3, 239/533.11, 585.1, 585.2, 585.3, 585.4, 585.5; 251/129.14, 129.21, 318; 137/625.33

[56] References Cited

U.S. PATENT DOCUMENTS

| | | | |
|---|---|---|---|
| 4,597,558 | 7/1986 | Hafner et al. . | |
| 5,192,048 | 3/1993 | Wakeman | 239/585.5 |
| 5,209,408 | 5/1993 | Reiter | 239/585.4 |
| 5,222,673 | 6/1993 | Reiter | 239/585.4 |
| 5,255,855 | 10/1993 | Maier et al. | 239/585.4 |
| 5,263,648 | 11/1993 | Vogt et al. | 239/585.4 |
| 5,285,969 | 2/1994 | Greiner et al. | 239/585.1 |
| 5,299,776 | 4/1994 | Brinn, Jr. et al. | 239/585.3 |
| 5,417,373 | 5/1995 | Facchin | 239/585.3 |
| 5,441,679 | 8/1995 | Chalich | 264/39 |
| 5,704,553 | 1/1998 | Wieczorek et al. | 239/585.1 |
| 5,752,689 | 5/1998 | Barkhimer et al. | 239/585.4 |
| 6,012,701 | 1/2000 | Reiter | 239/585.4 |
| 6,015,103 | 1/2000 | Kotkowicz | 239/585.4 |

*Primary Examiner*—Andres Kashnikow
*Assistant Examiner*—Christopher S. Kim
*Attorney, Agent, or Firm*—John A. VanOphem

[57] ABSTRACT

An injector fuel injection valve is guided at the lower end by a plastic valve guide mounted in a nozzle containing a valve seat engagable by the valve element. The valve guide includes inwardly protruding annularly spaced ribs having inner guide surfaces and defining spaced flow channels. The guide surfaces engage the circular or spherical exterior of the valve element to guide the element to properly aligned seating against the conical valve seat. The plastic or polymeric valve guide is preferably molded in place within the cup shaped metal nozzle but, if desired, the valve guide may be separately molded and subsequently inserted or snapped in place within the nozzle. A second plastic valve guide may be provided for guiding the upper end of an associated armature. A plastic or polymeric ring is molded in place or otherwise mounted within a groove around the outer surface of the armature and engagable with a cylindrical tube disposed within a main body of the injector to which the injection nozzle is secured.

19 Claims, 5 Drawing Sheets

FUEL INJECTOR WITH MOLDED PLASTIC VALVE GUIDES

TECHNICAL FIELD

This invention relates to fuel injectors for metering of fuel to the intake system of an internal combustion engine and, more particularly, to molded plastic valve guides for the injection valves of such injectors.

BACKGROUND OF THE INVENTION

It is known in the art relating to engine fuel injectors to provide a reciprocating injection valve which seats against a valve seat and is guided in reciprocation by upper and lower valve guide surfaces. U.S. Pat. No. 5,755,386 granted May 26, 1998, describes in detail the structure of one form of such injector and the construction and purposes of guiding the injection valve in such injector. Reference to this patent may be helpful in understanding both the background and structure of prior art injectors having injection valve guides.

SUMMARY OF THE INVENTION

The present invention provides improved injection valve guides for injectors, especially of the type described in the above-identified U.S. Pat. No. 5,755,386. In such injectors, the injection valve includes a curved end or spherical valve element, axially connected to a tubular magnetic armature. The armature is actuated by an electromagnetic coil to open the valve and by a return spring to close the valve.

According to the invention, the injection valve is guided at the lower end by a plastic valve guide mounted in a nozzle containing a valve seat engagable by the valve element. The valve guide includes inwardly protruding annularly spaced ribs having inner guide surfaces and defining spaced flow channels. The guide surfaces engage the circular or spherical exterior of the valve element to guide the element to properly aligned seating against a conical valve seat surface. The plastic or polymeric valve guide is preferably molded in place within the cup shaped metal nozzle but, if desired, the valve guide may be separately molded and subsequently inserted or snapped in place within the injector nozzle.

A second plastic valve guide may be provided for guiding the upper end of the associated armature. A plastic or polymeric ring is molded in place or otherwise mounted within a groove around the outer surface of the armature and engagable with a guide sleeve disposed within a main body of the injector to which the injection nozzle is secured.

These and other features and advantages of the invention will be more fully understood from the following description of certain specific embodiments of the invention taken together with the accompanying drawings.

DESCRIPTION OF THE PREFERRED EMBODIMENT

Figure 1:
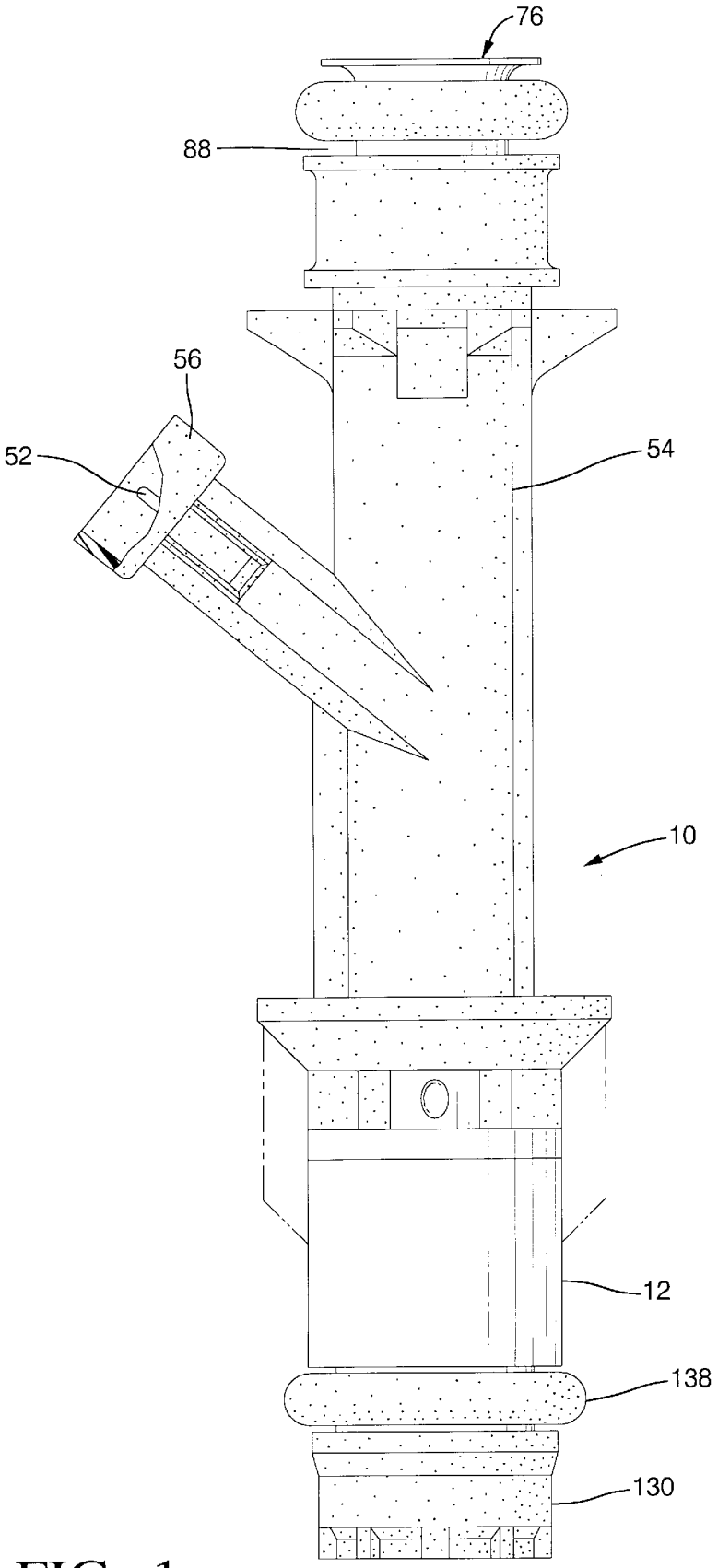
FIG. 1 is a side view of a fuel injector embodying features of the present invention.
Figure 2:
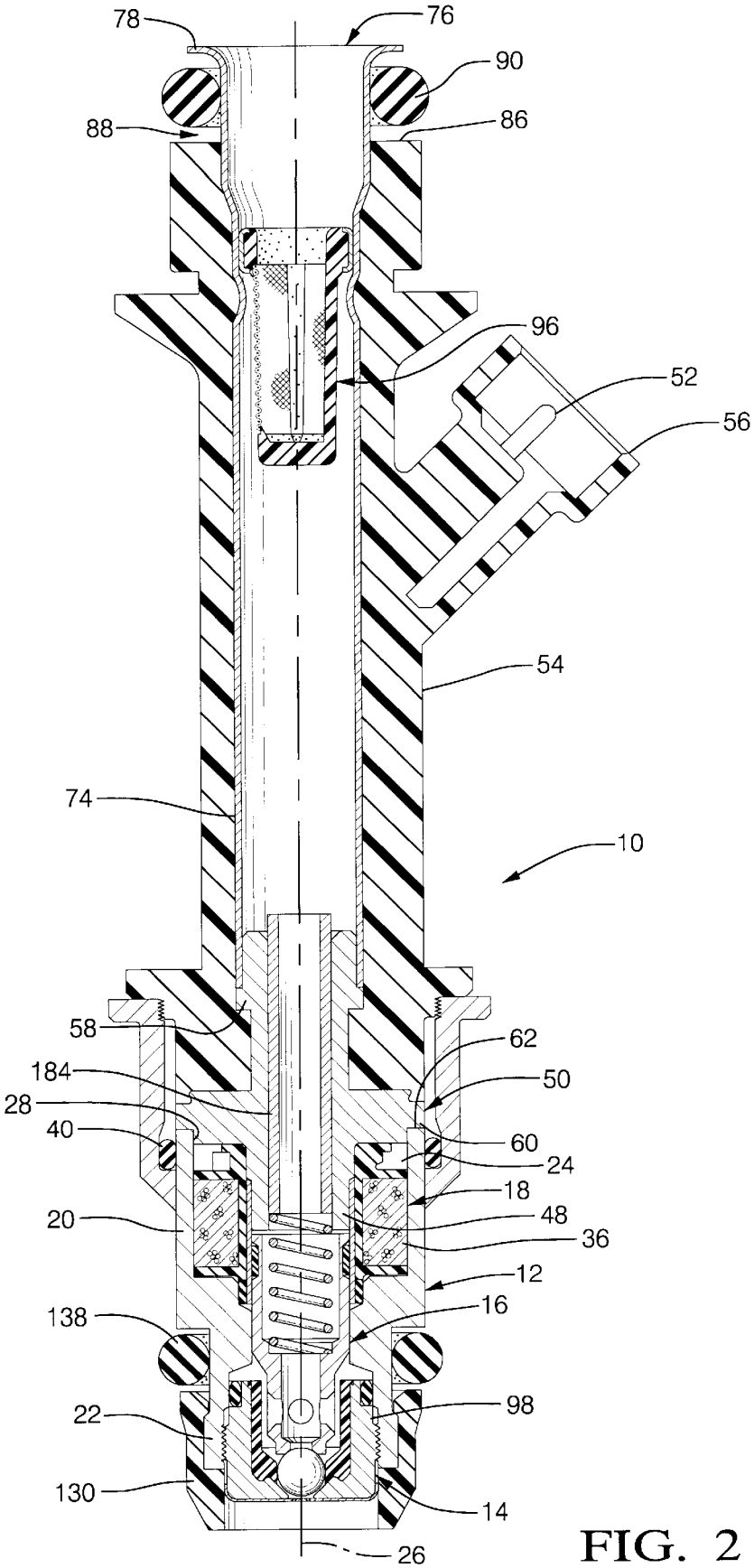
FIG. 2 is a cross-sectional view of the injector of FIG. 1.
Figure 3:
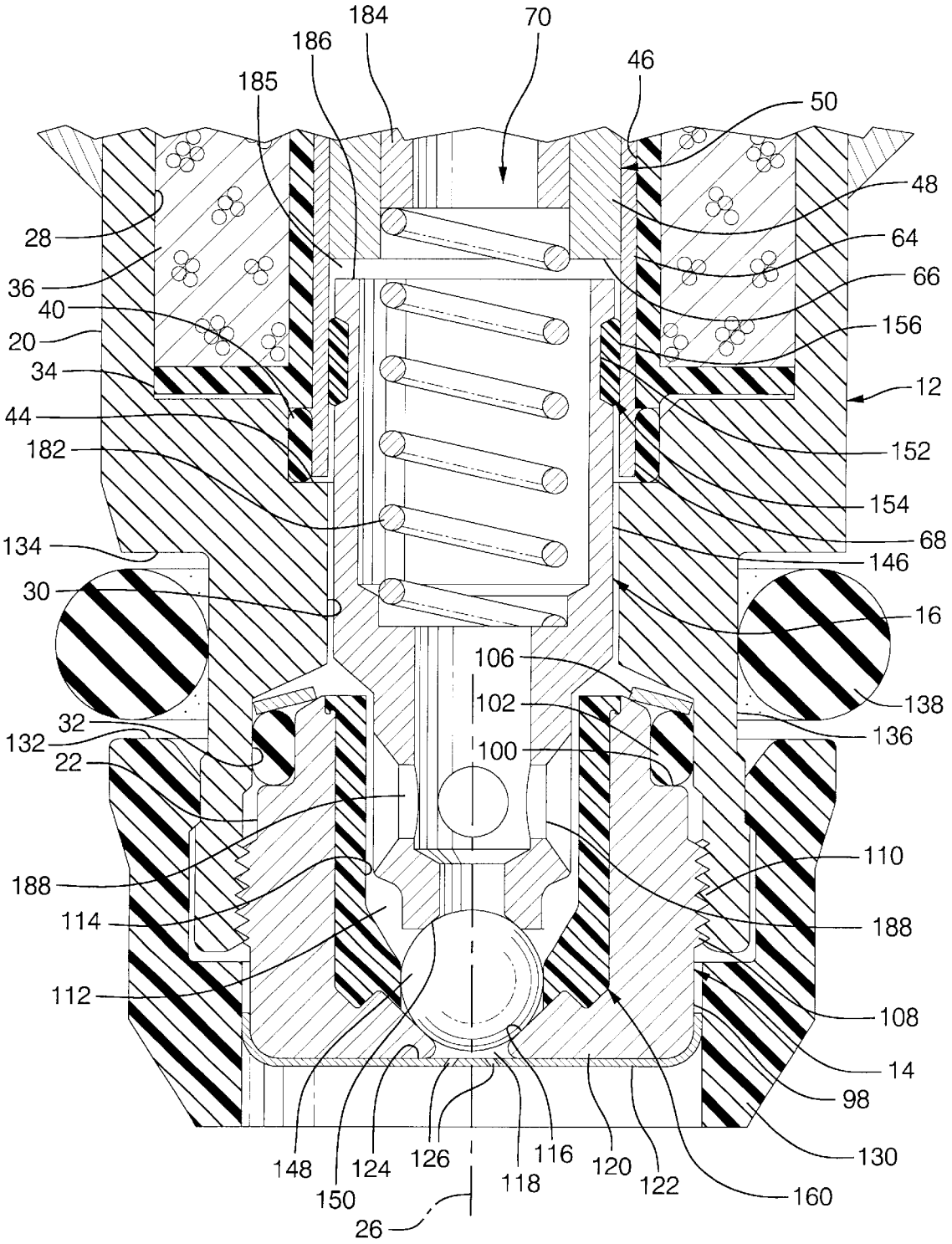
FIG. 3 is an enlarged cross section of the lower portion of FIG. 2.

Referring to FIGS. 1–3, numeral 10 generally indicates an electromagnetic fuel injector having as major components a body 12, a nozzle 14, a valve member 16 and a solenoid assembly 18 used to control movement of the valve member 16.

In the embodiment illustrated, the body 12 is of cylindrical, hollow tubular configuration and is shaped to permit direct insertion, if desired, of the injector 10 into a socket provided for this purpose in an engine intake manifold, not shown.

The body 12 includes an enlarged upper solenoid case portion 20 and a lower end, nozzle case portion 22 of reduced internal and external diameter relative to the solenoid portion 20. An internal cylindrical cavity 24 is formed in the body 12 by a stepped bore therethrough that is substantially coaxial with the axis 26 of the body. The cavity 24 includes a cylindrical upper wall 28, a cylindrical intermediate wall 30 and a cylindrical lower wall 32. Wall 30 is of a reduced diameter relative to upper and lower wall portions 28 and 32, respectively.

Solenoid assembly 18 is disposed within the enlarged upper solenoid case portion 20 and includes a spool-like, tubular bobbin 34 supporting a wound wire solenoid coil 36. A resilient sealing member, such as an O-ring 40, is disposed between the tubular bobbin 34 and a seal shoulder 44 in the cylindrical intermediate wall 30. The bobbin 34 is provided with a central through bore 46 encircling a lower, reduced diameter pole portion 48 of a pole piece 50. A pair of terminal leads 52 are operatively connected at one end to the solenoid coil 36 and each such lead has a second end extending upwardly through an outer, overmolded casing 54, to terminate in a terminal socket 56, for connection of the fuel injector to a suitable source of electrical power in a manner well known in the art.

Pole piece 50 includes an upper cylindrical portion 58, a centrally located circular, radial flange portion 60 and the lower reduced diameter cylindrical pole 48. The circular, radial flange portion 60 is slidably received at its outer peripheral edge within the cylindrical upper wall 28 of the body 12 to thereby close the enlarged upper solenoid case portion 20 of the body 12 and retain the solenoid assembly 18 therein. Pole piece 50 is axially retained within the upper cylindrical portion of the body 12 by welding or bonding the flange portion 60 to a shoulder 62 along the upper, open end of wall 28.

The lower cylindrical pole 48 is slidably received in the central through bore 46 that extends coaxially through the coil bobbin 34. A cylindrical tube 64 of nonmagnetic material, such as stamped or drawn metal, is received about the lower end of the lower cylindrical pole 48 of the pole piece 50. The tube may be welded or bonded or otherwise sealed to the lower pole piece 48 so as to prevent fuel penetration of the joint between the tube 64 and the pole. The tube 64 extends axially downwardly beyond the lower end, working surface 66 of the lower cylindrical pole 48. The outer surface 68 of the extended portion of the tube 64 acts as an interface with resilient sealing member 40, operating to seal the central fuel passage 70 of the fuel injector 10 from solenoid assembly 18.

The upwardly extending cylindrical boss 58, of pole piece 50, is configured to receive an axially upwardly extending, deep drawn fuel inlet tube 74. The inlet tube has a first inlet end 76 having a flanged end portion 78. The fuel inlet tube 74 is fixed to the pole piece 50 and encased by overmolded upper housing 54, which is formed of a suitable encapsulant material and, as described above, also includes an integral terminal socket 56 with leads 52. An upper seal shoulder 86 formed in the overmolded housing 54 is axially spaced from the tube flange 78 to define an annular seal groove 88 configured to carry a resilient sealing member, such as O-ring 90, for leak free attachment to a source of pressurized fuel, not shown. Within the fuel inlet tube 74, the injector fuel filter assembly 96 traps fuel contaminants.

The nozzle 14 includes a nozzle body 98 having a cup-shaped, tubular configuration with a stepped upper shoulder 100 configured to receive a sealing member, such as O-ring 102. The sealing member 102 is disposed between the nozzle body shoulder 100 and a washer spring 106 as well as between the nozzle case lower wall 32 and the nozzle body 98, thereby establishing a seal against leakage at the interface of the nozzle 14 and the body 12. The nozzle body 98 includes external threads 108 which engage corresponding internal threads 110 in the lower wall 32 of the body 12, providing axial adjustability of the nozzle body within the injector body. An internal cylindrical cavity 112 in the nozzle body 98 is defined by an inner cylindrical wall 114 which extends from the open, upper end of the nozzle body to terminate in an annular, frustoconical valve seat 116 disposed about an axially aligned, fuel discharge opening 118 at the lower end thereof. The cylindrical cavity 112 operates as a fuel supply passage within the nozzle assembly 14.

The lower end 120 of the nozzle body 98 is fitted with a fuel spray director plate 122. Fuel passing through the fuel discharge opening 118 in the valve seat 116 is delivered to the upstream side, or face 124 of the director plate 122 where it is distributed across the face to spray holes 126. The spray holes 126 are oriented in a predetermined configuration which will generate, in the discharged fuel, a desired spray configuration.

A cylindrical retainer 130 is also mounted around the lower end 120 of nozzle body 98. The retainer includes an upper annular shoulder 132 which defines, with shoulder 134 of body 12, an annular groove 136 for the placement of a resilient seal 138. The cylindrical retainer 130 is preferably constructed of a durable, temperature resistant plastic, such as nylon, and is snapped over the lower end, nozzle case portion 22 of the body 12.

The valve member 16 includes a tubular armature 146 and a valve element 148, the latter being made of, for example, a spherical ball having a predetermined radius, which is welded to the lower annular end 150 of the tubular armature 146. The radius of the valve element 148 is chosen for seating engagement with the valve seat 116. The tubular armature 146 is formed with a predetermined outside diameter so as to be loosely slidable within the nonmagnetic cylindrical tube 64 received about and extending from the lower pole piece 48. The tube 64 extends coaxially with axis 26 of the injector 10, along which the valve member 16 is centered.

The armature 146 includes an annular recess 152 near its upper end in which an upper annular guide 154 is molded. Guide 154 is preferably made of a polymer type material with thermal characteristics similar to the base material of the armature. Guide 154 extends radially beyond the armature with an outer surface 156 engaging the cylindrical tube 64 for guiding the upper end of the valve member 16.

Figure 4:
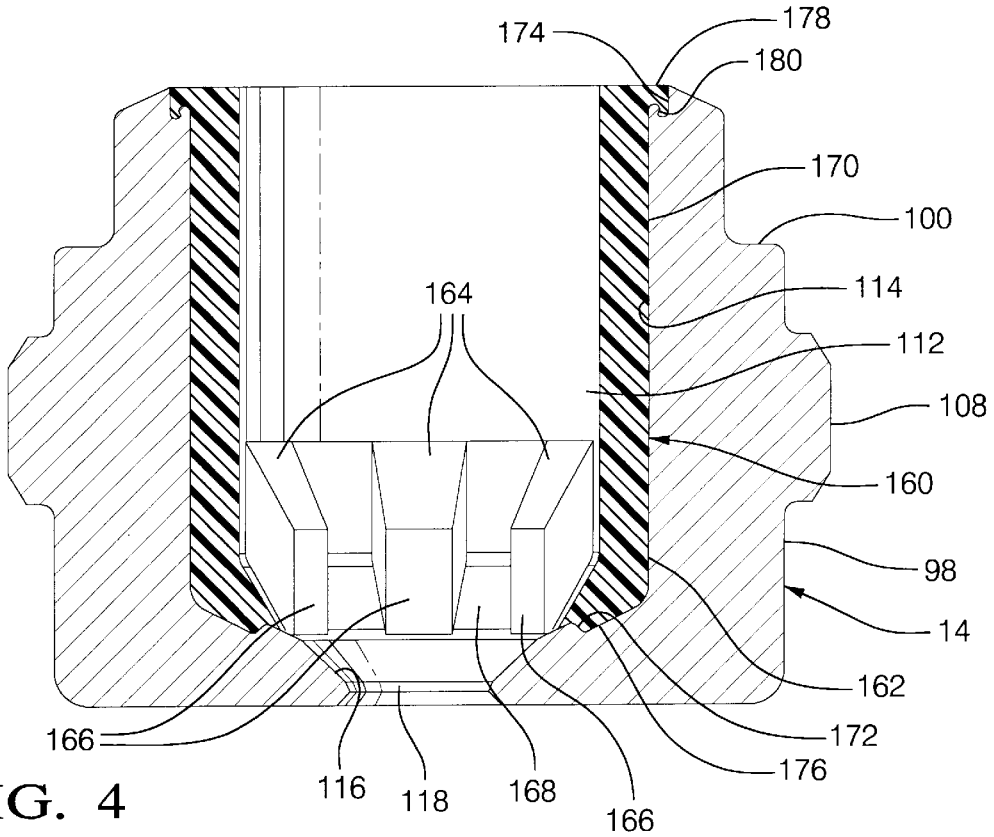
FIG. 4 is an enlarged cross-sectional view of the nozzle and valve guide assembly of FIGS. 1–3.
Figure 5:
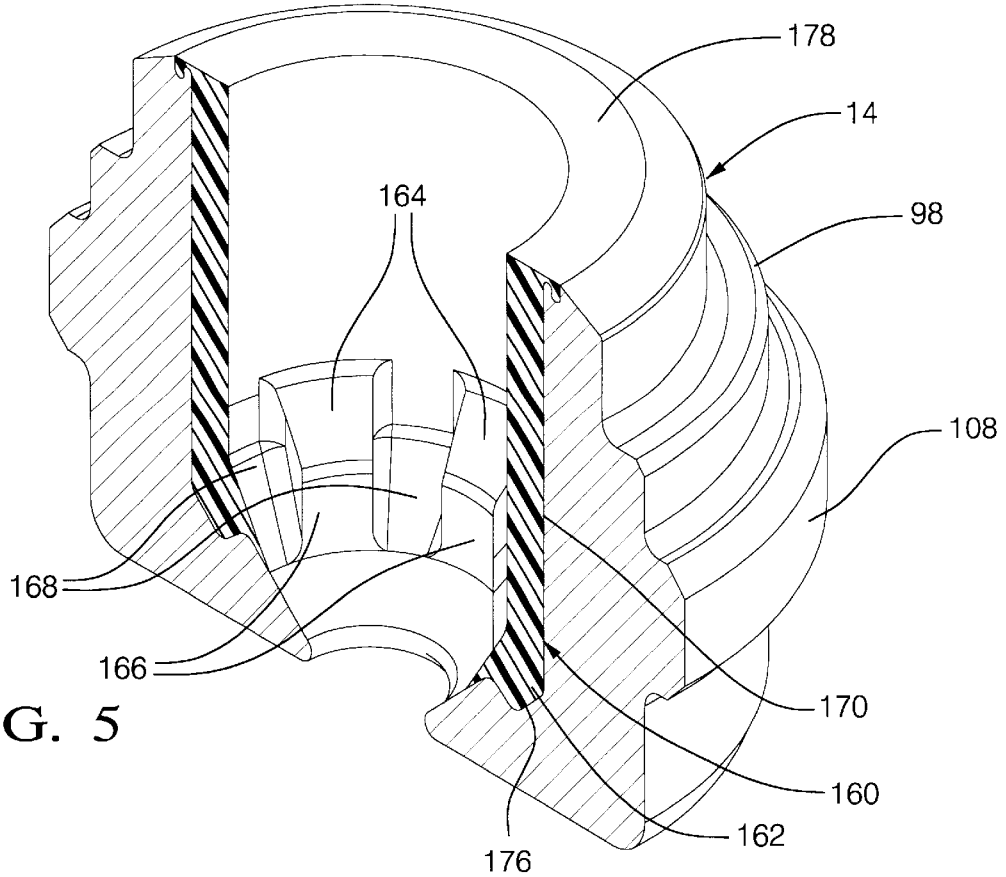
FIG. 5 is a cross-sectional pictorial view of the assembly of FIG. 4.

Positioned within the cylindrical cavity 112 of the nozzle body 98, adjacent the valve seat 116, is a lower valve guide 160. The valve guide 160, shown in detail in FIGS. 4 and 5, may be a polymer material insert which is either molded in place or snap fitted within the inner cylindrical wall of the nozzle body 98. Valve guide 160 includes an annular wall 162 spaced axially adjacent the valve seat 116.

A plurality of guide ribs 164 extend inward from the annular wall 162 and define annularly spaced guide surfaces 166. The guide surfaces engage the valve element 148 for guiding reciprocating axial motion of the lower end of the valve member 16 toward and away from a seated position. The guide ribs 164 define flow channels 168 extending longitudinally between the ribs to conduct fuel to the valve seat for discharge through the discharge opening when the valve member 16 is moved to an unseated or open position. In a preferred embodiment, the flow channels 168 are positioned at circumferentially spaced locations about the annular wall 162. The circumferential placement of the flow channels 168 around the valve element and above the valve seat provides a uniform fuel flow to the valve seat. The fuel delivery pressure below the valve seat is thereby balanced and improves the consistency of fuel flow through the spray holes 126 in the director plate 122.

In the embodiment of FIGS. 1–5, the annular wall 162 of valve guide 160 includes a cylindrical portion 170 extending axially upward along the inner cylindrical wall 114 of the nozzle body 98 to the upper or inlet end of the wall 114. First and second annular recesses 172, 174 are provided in the nozzle body wall 114 adjacent lower and upper ends 176, 178 of the valve guide 160. The ends 176, 178 are shaped to fill recesses 172, 174, the upper end 178 being formed as a radial flange. At least one of the recesses may include a reverse angled portion 180 to provide for positive retention of the guide 160 insert in the nozzle body 98, especially when assembled by snap fitting.

Molding of the upper and lower valve guides 154, 160 from polymer like materials either in place or for snap-in installation in the nozzle body simplifies the manufacturing and assembly of these components in the injector. By close tolerance location of the guide surfaces 166 relative to the valve seat 116, these components are prealigned so that proper seating of the valve element on the valve seat is assured without further alignment steps being required in assembly of the nozzle body to the injector body lower wall 32. The polymer based valve guides, lower guide 160 and upper guide 154 provide low cost and robust guiding surfaces for the valve member 16.

The upper annular guide 154 and the valve guide 160 cooperate to control movement of the valve member 16, in the longitudinal direction, within the injector 10. The valve element 148 of valve member 16 is normally biased into a closed, seated engagement with the valve seat 116 by a biasing member such as valve return spring 182 of predetermined spring force which is inserted into the upstream end of the tubular armature 146.

A calibration sleeve 184 is inserted into the central, through bore 46 of pole piece 50 to engage the spring 182. The calibration sleeve 184 is moved axially towards the valve seat 116 to increase the spring preload and withdrawn to lessen the spring preload on the valve member 16. The calibration sleeve 184 is fixed in position within the pole piece 50 when the desired spring preload is set.

A working air gap 185 is defined between the working surface 186 at the upper end of armature tube 146 of the valve member 16 and the working surface 66 at the lower end of the pole piece 50. Upon energization of the solenoid assembly 18, the tubular armature 146 and associated valve element 148 is drawn upwardly and off of the valve seat 116 against the bias of the spring member 182 to close the working air gap 185. Fuel flows from a pressurized source into the first inlet end 76 of the fuel inlet tube 74, through the length of the tube 74 and enters the body 12 through the pole piece 50. Fuel then flows through the tubular armature 146 and into the fuel chamber 112 in nozzle body 98 through circumferentially spaced openings 188 in the second end of the armature tube 146. As described above, the fuel passes through the flow channels 168 in the valve guide 160 and exits the valve body 98 through the opening 118 in valve seat 116.

Fuel exiting the valve seat 116 is distributed onto the upstream side 124 of the spray director plate 122 passes through the spray holes 126 in the plate for discharge from the fuel injector 10. Deenergization of the solenoid assembly 18 allows the field within the magnetic circuit defied by the pole piece 50, the body 12, and the armature 146 to collapse, thereby allowing the valve member to return to the closed position against the valve seat 116 under the bias of the spring 182 to stop the flow of fuel.

Figure 6:
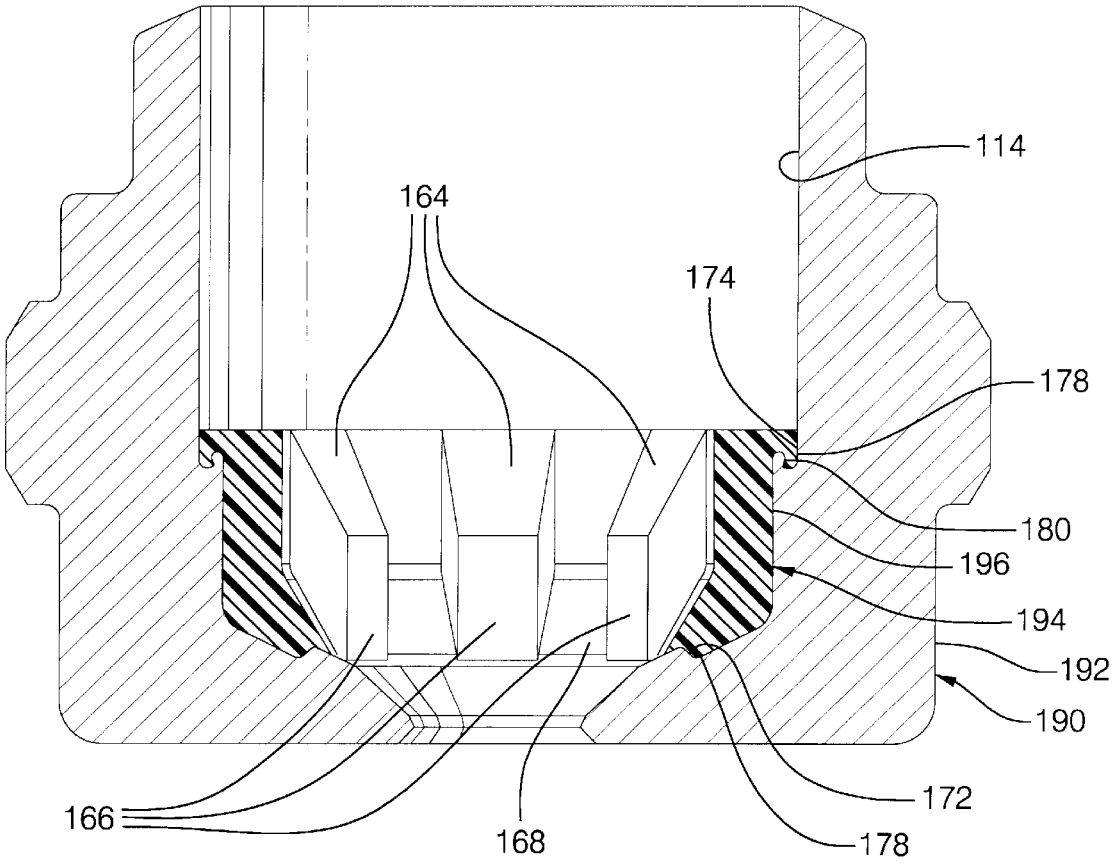
FIG. 6 is a cross-sectional view of an alternative embodiment of nozzle and valve guide assembly.

FIG. 6 shows an alternative embodiment of nozzle 190 wherein like numerals indicate like features. Nozzle 190 includes a modified nozzle body 192 enclosing a modified valve guide 194 which may be molded in place or snap fitted into the nozzle body 192. Guide 194 is similar to the valve guide 160 previously discussed but differs in omitting the upstanding cylindrical portion 170 of guide 160. Guide 194 still includes an annular wall 196 and guide ribs 164, guide surfaces 166 and flow channels 168 like those previously described. However, guide 194 is ended at the top of the guide ribs 164 with a flanged upper end 178 fitted into a second annular recess 174 located at a lower portion of the inner wall 114 of the valve body adjacent the tops of the ribs 164. A reverse angled portion 180 may be provided as before for snap fitting if desired. A first annular recess 172 in the nozzle body 192 and a cooperating lower end 178 of the guide 194 are provided as before. The alternative embodiment functions in the manner previously described and represents only one of many possible modifications that may be made incorporating the features of the invention.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A fuel injector for metering fuel into an internal combustion engine, the injector comprising a cup shaped nozzle having an internal cavity defined by a cylindrical wall centered on an axis and open at an inlet end, the wall having at an opposite discharge end an annular valve seat surrounding a discharge opening;

a valve member including a magnetic armature connected with a valve element seatable on the valve seat to close the discharge opening and axially movable away from the valve seat to open the discharge opening to flow; and a valve guide of plastic mounted on the cylindrical wall within the cavity, the guide including an annular wall spaced axially adjacent the valve seat and a plurality of guide ribs extending inwardly from the annular wall and defining annularly spaced guide surfaces engagable with the valve element for guiding reciprocating axial motion of the valve element toward and away from a seated position, where the guide ribs defining longitudinally extending flow channels therebetween effective to conduct fuel to the valve seat for discharge through the discharge opening when the valve element is moved to an open position, and the annular wall is secured in the cavity by a first circular recess in the cylindrical wall adjacent the valve seat and a second circular recess in the cylindrical wall spaced upward from the valve seat.

2. A fuel injector as in claim 1 wherein said annular wall has a cylindrical portion extending axially to said inlet end of the cylindrical wall.

3. A fuel injector as in claim 1 wherein said annular wall has a cylindrical portion extending axially to said inlet end of the cylindrical wall and said second circular recess is formed at said inlet end.

4. A fuel injector as in claim 1 wherein said valve seat has a generally conical surface and the valve element has a rounded end seatable on the conical surface and a circular periphery guided by said guide surface.

5. A fuel injector as in claim 4 wherein said valve element is spherical.

6. A fuel injector as in claim 1 wherein said valve guide is molded in place in the nozzle.

7. A fuel injector as in claim 1 wherein said valve guide is molded as a separate member subsequently inserted in the nozzle.

8. A fuel injector as in claim 1 wherein at least one of said circular recesses and an associated portion of said annular wall are configured to provide snap in retention of the valve guide within the nozzle.

9. A fuel injector as in claim 1 wherein said plastic is a polymeric material.

10. A fuel injector as in claim 1 wherein said magnetic armature has an external surface guided by an internal surface of the fuel injector separate from said nozzle, one of said armature external surface and said injector internal surface being formed of a plastic material.

11. A fuel injector as in claim 10 wherein said plastic material is a polymeric ring retained in an external groove in the armature.

12. A fuel injector as in claim 11 wherein said polymeric ring is molded in place in said groove of the armature.

13. A fuel injector for metering fuel into an internal combustion engine, the injector comprising a cup shaped nozzle having an internal cavity defined by a cylindrical wall centered on an axis and open at an inlet end, the wall having at an opposite discharge end an annular valve seat surrounding a discharge opening;

a valve member including a magnetic armature connected with a valve element seatable on the valve seat to close the discharge opening and axially movable away from the valve seat to open the discharge opening to flow, said magnetic armature includes a polymeric ring retained in an external groove in the magnetic armature, thereby providing an external surface that is guided by an internal surface of the fuel injector separate from said nozzle; and a valve guide of plastic mounted on the cylindrical wall within the cavity, the guide including an annular wall spaced axially adjacent the valve seat and a plurality of guide ribs extending inwardly from the annular wall and defining annularly spaced guide surfaces engagable with the valve element for guiding reciprocating axial motion of the valve element toward and away from a seated position, the guide ribs defining longitudinally extending flow channels therebetween effective to conduct fuel to the valve seat for discharge through the discharge opening when the valve element is moved to an open position.

14. A fuel injector as in claim 13 wherein said annular wall is secured in the cavity by a first circular recess in the cylindrical wall adjacent the valve seat and a second circular recess in the cylindrical wall spaced upward from the valve seat.

15. A fuel injector as in claim 13 wherein said valve seat has a generally conical surface and the valve element has a rounded end seatable on the conical surface and a circular periphery guided by said guide surface.

16. A fuel injector as in claim 13 wherein said valve guide is molded in place in the nozzle.

17. A fuel injector as in claim 13 wherein said valve guide is molded as a separate member subsequently inserted in the nozzle.

18. A fuel injector as in claim 14 wherein at least one of said circular recesses and an associated portion of said annular wall are configured to provide snap in retention of the valve guide within the nozzle.

19. A fuel injector as in claim 13 wherein said polymeric ring is molded in place in said groove of the armature.

* * * * *